US006938624B2

(12) United States Patent
Arroyo et al.

(10) Patent No.: US 6,938,624 B2
(45) Date of Patent: Sep. 6, 2005

(54) METHODS AND DEVICES FOR APPLYING HAIR EXTENSIONS

(75) Inventors: Marisol S. Arroyo, N. Hollywood, CA (US); Jose R. Arroyo, N. Hollywood, CA (US)

(73) Assignee: Hairlocs, Inc., N. Hollywood, CA (US)

( * ) Notice: Subject to any disclaimer, the term of this patent is extended or adjusted under 35 U.S.C. 154(b) by 35 days.

(21) Appl. No.: 10/355,580

(22) Filed: Jan. 30, 2003

(65) Prior Publication Data

US 2004/0149301 A1 Aug. 5, 2004

(51) Int. Cl.[7] ..... A41G 3/00; A41G 5/00
(52) U.S. Cl. ..... 132/201
(58) Field of Search ..... 132/201, 53, 54, 132/55, 56

(56) References Cited

U.S. PATENT DOCUMENTS

| | | | | | |
|---|---|---|---|---|---|
| 2,583,625 | A | * | 1/1952 | Bergan | 29/517 |
| 4,934,387 | A | | 6/1990 | Megna | 132/201 |
| 4,986,620 | A | * | 1/1991 | Severijns et al. | 385/15 |
| 5,072,745 | A | | 12/1991 | Cheh | 132/201 |
| 5,107,867 | A | | 4/1992 | Barrington | 132/201 |
| 5,121,761 | A | | 6/1992 | Meister | 132/201 |
| 5,575,298 | A | | 11/1996 | Hinton | 132/200 |
| 5,752,530 | A | | 5/1998 | Traintinger | 132/201 |
| 5,868,145 | A | | 2/1999 | Spann | 132/201 |
| 5,894,846 | A | | 4/1999 | Gang | 132/201 |
| 6,109,274 | A | * | 8/2000 | Ingersoll | 132/201 |
| 6,405,736 | B2 | | 6/2002 | Townsend | 132/201 |
| 2001/0035192 | A1 | | 11/2001 | Townsend | 132/201 |
| 2001/0037813 | A1 | | 11/2001 | Ra | 132/53 |
| 2002/0185146 | A1 | | 12/2002 | Gold | 132/201 |

FOREIGN PATENT DOCUMENTS

| | | |
|---|---|---|
| DE | 3722108 | 12/1989 |
| DE | 20009406 | 9/2000 |
| GB | 2271057 | 6/1994 |
| WO | WO 8909551 | 10/1989 |

* cited by examiner

*Primary Examiner*—John J. Wilson
*Assistant Examiner*—Robyn Doan
(74) *Attorney, Agent, or Firm*—Koppel, Jacobs, Patrick & Heybl; Michael J. Ram

(57) ABSTRACT

A system for applying hair extensions to natural hair growing on the scalp of an individual comprises flared cylindrical tubes, a threading hook and a crimping tool. The threading tool is used to feed scalp hair through the flared tube. The hair extension is then inserted into the flared end or the tube and the tube is crushed flat trapping the threaded scalp hair and hair extension within the crushed structure. The removal of the hair extension is facilitated by use of a removal tool designed to open the crimped flared tube.

5 Claims, 10 Drawing Sheets

METHODS AND DEVICES FOR APPLYING HAIR EXTENSIONS

The invention relates to a system, and a method of utilizing that system, to attach natural or artificial hair extensions, hair pieces or other hair enhancers to natural hair growing on an individual's head to lengthen or thicken the appearance of the hair.

BACKGROUND

There are a wide variety of techniques and procedures to provide an individual with a fuller or longer appearing head of hair. In describing the invention and methods of supplementing natural hair growth, the natural hair growing on the head of an individual will be referred to as "scalp hair", also medically designated as capillus or capilli. The simplest approach is to apply a wig or add hair pieces such as pony tails, braids or wefts. A permanent procedure is the use of hair plugs which are surgically implanted. A temporary method suitable for longer periods of time is to sew or weave strands of natural hair or synthetic hair replacements into normal hair growing on the scalp. Alternatively, hair extensions may be adhesively secured to the scalp or hair growing from the scalp. A still further method is to use small clamps or clips for the attachment of strands or bundles of hair, referred to as a hair extensions, to multiplestrands of scalp hair.

U.S. Pat. No. 4,934,387 shows the use of a thermoplastic glue, U.S. Pat. No. 5,072,745 discloses use of a hot melt adhesive, U.S. Pat. No. 5,575,298 uses a contact adhesive, U.S. Pat. No. 5,868,145 uses a liquid latex along with a cyanoacrylate adhesive, U.S. Pat. No. 6,405,736 and U.S. Published Applications 2002/0185146, 2001/0035192 and 2001/0037813 each disclose a self adhesive tape for attaching an extension or multiple extensions to the scalp. U.S. Pat. No. 5,107,867 describes the use of a thermosetting adhesive in combination with a heat shrinkable tubing. These techniques require the use of heat and/or solvents to reverse the attachment process.

U.S. Pat. No. 5,121,761 describes a method of attaching hair extensions which first requires securing anchors to multiple strands of hair attached to the scalp, forming the hair extensions into a single wide hair piece with an upper weave portion an attaching that weave portion to the anchors.

U.S. Pat. No. 5,894,846 describes the attachment of hair extensions to strands of knotted, scalp hair using heat shrinkable tubes. The hair is first knotted to form an enlarged portion that is readily trapped in the tubing after heat is applied to cause shrinking, of the tubing.

U.S. Pat. No. 5,752,530 to Taintinger describes a process for attaching hair extensions to scalp hair which comprises using a clamping tool to temporarily clamp loose strands of a hair extension to gathered strands of hair near the scalp, placing the combined hair extension and scalp hair strands through a threading loop and then pulling that combination through a straight cylindrical sleeve. The hair extension and scalp hair are then trapped in the sleeve by crushing the cylindrical sleeve first into a U or V shape, with the bottom of the U or V extending along the length of the cylindrical sleeve (parallel to the hair strands), to loosely grasp the strands, sliding the sleeve along the strands until it is close to the scalp and then further folding the sleeve over on itself (i.e. folding the sleeve in half longitudinally) thus compressing the U or V shape, trapping the hair strands within the crushed, folded sleeve. Special pliers which includes a U or V shaped groove in one face and a matching anvil shaped extension in the other face of the plier jaws are used to form the tube into the desired hollow U or V configuration with the hair within the reshaped hollow cylinder. Another portion of the plier jaws is then used to complete the formation of the folded U or V shaped cylinder. To undo the process (remove the hair extension) the pointed tips of the pliers are used to unfold the folded U or V, releasing the compressive forces on the scalp hair and hair extension.

Each of the techniques disclosed in these referenced documents have problems in use and speed of application which are addressed by the current invention. The use of adhesives and the heat or chemicals described in previous published procedures required to attach or remove the hair extensions can be damaging to the natural hair and scalp. In addition, the adhesive materials also retain dirt and natural skin oils making them difficult to maintain in a clean manner. Heat shrinkable tubes are difficult to remove, particularly when the hair requires knotting and may necessitate cutting the natural hair to remove the extensions. Other tubular attachment means require additional tools for mounting the extensions and may be difficult and very time consuming for an individual to apply and remove.

Therefore, there is a need for a simple, fast and easy application technique for adding hair extensions. The devices and procedure embodying features of the present invention meet these needs.

SUMMARY OF THE INVENTION

Hair extensions are applied to natural hair growing on the scalp of an individual using flared cylindrical tubes, a threading hook and a specially design crimping tool. Because the crimped tube readily receives a removal tool designed to fit within the crimped tube, the extension can be readily removed at any time.

BRIEF DESCRIPTION OF THE DRAWINGS

FIG. 3 is a perspective side view of the flared tube of FIG. 1 after flattening crimping with the scalp hair and hair extension extending there from.

FIG. 7 is a side view of the flared tube of FIG. 1 after horizontal crimping with the scalp hair and hair extension extending there from.

FIG. 8 is a side view of the flared tube of FIG. 1 after longitudinal crimping with the scalp hair and hair extension extending there from.

FIG. 9 is a side view of the flared tube of FIG. 1 after diagonal crimping with the scalp hair and hair extension extending there from.

DETAILED DESCRIPTION

Figure 1:
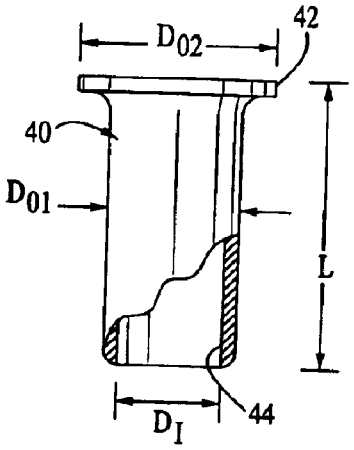
FIG. 1 is a partially cut-away side view of an embodiment of a flared tube, which incorporates features of the invention, for receiving the scalp hair and hair extension.

An attachment system for applying a hair extension 30 that embodies features of the invention comprises an assortment of various size flared tubes 40, a threading tool 50 for use in pulling scalp hair through the flared tube 40, a crimping tool 60 for securing both the scalp hair and the hair extension within the flared tube 40 and a releasing tool 70 for opening, at a later time, the flared tube 40 for removal of the hair extensions 30.

Figure 2:
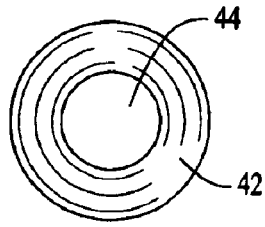
FIG. 2 is a view of the flared end of the tube of FIG. 1.
Figure 10:
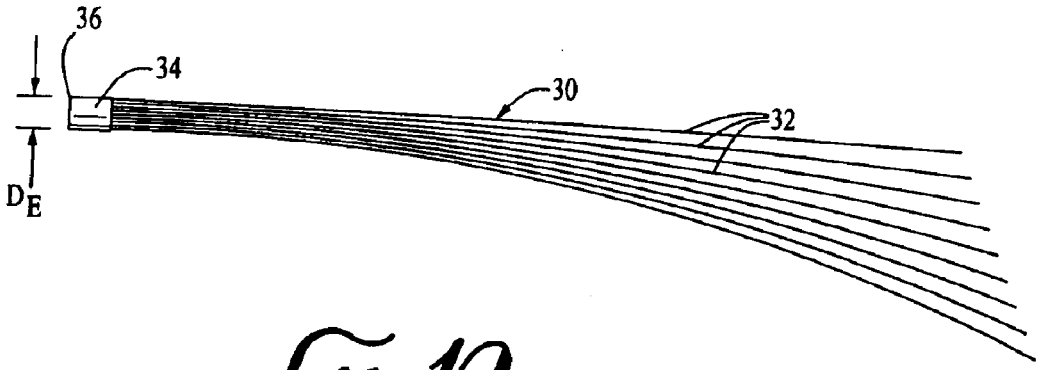
FIG. 10 is a side view of a hair plug.
Figure 3:
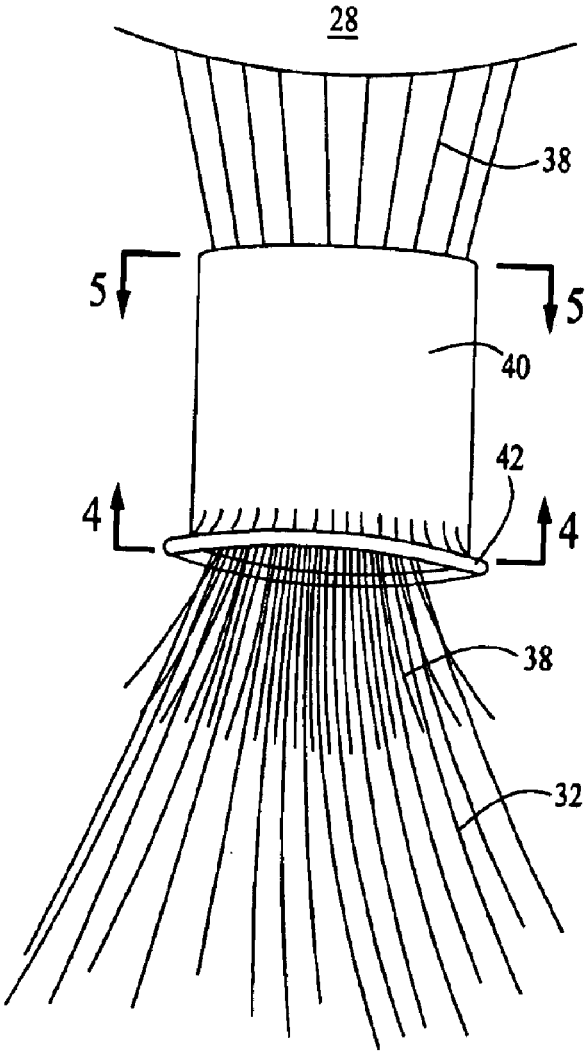
Figure 6:
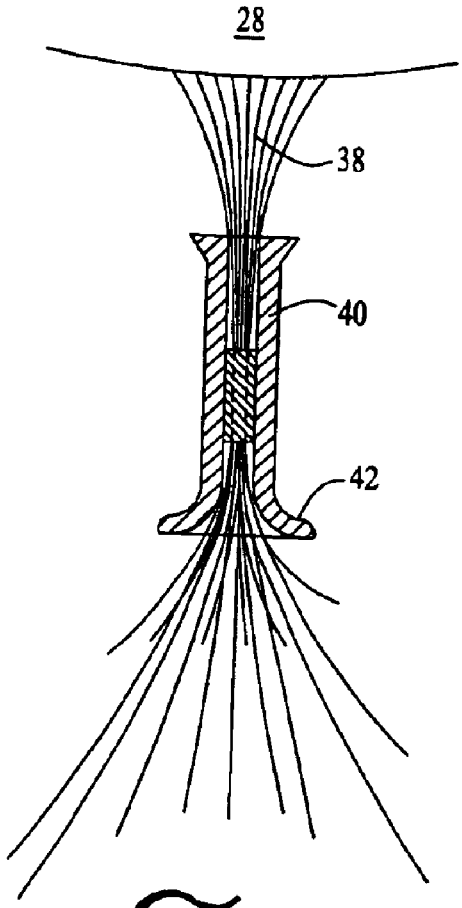
FIG. 6 is a view of FIG. 3 rotated 90° around a central longitudinal axis and cutaway longitudinally.
Figure 4:
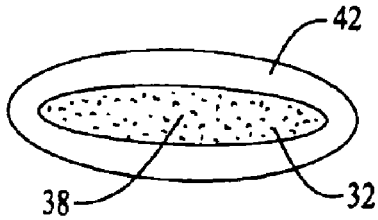
FIG. 4 is a bottom end view of the flared tube of FIG. 3 taken along line 4—4 of FIG. 3.
Figure 5:
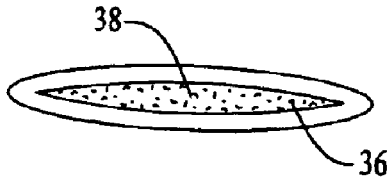
FIG. 5 is a top end view of the flared tube of FIG. 3 taken along line 5—5 of FIG. 3.
Figure 7:
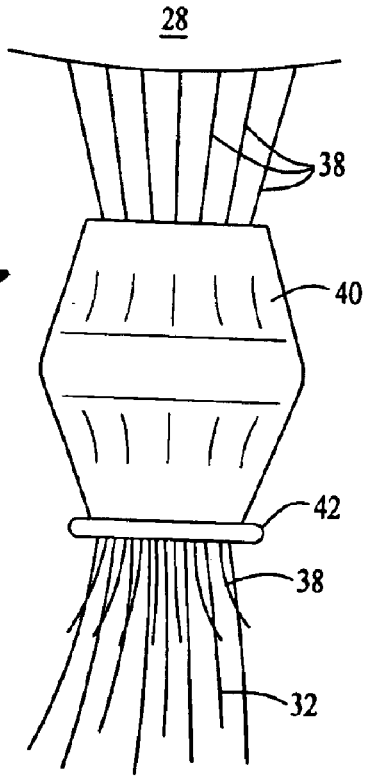
Figure 8:
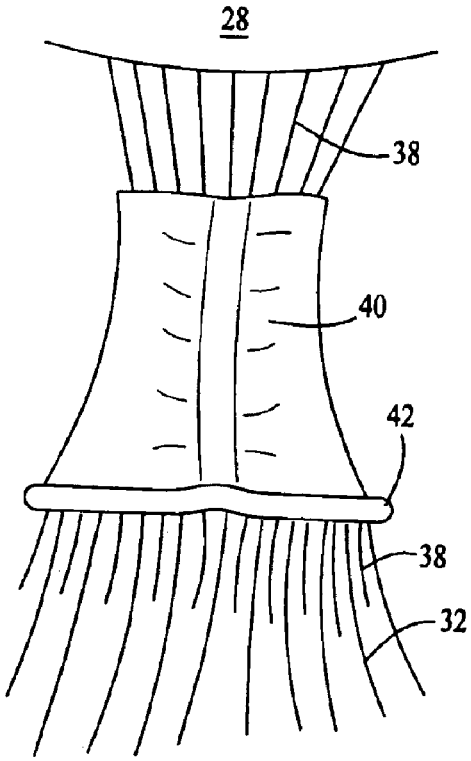
Figure 9:
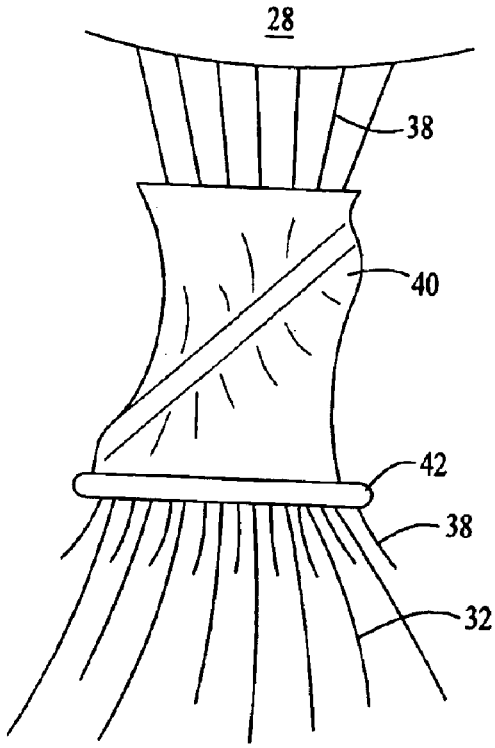
Figure 19:
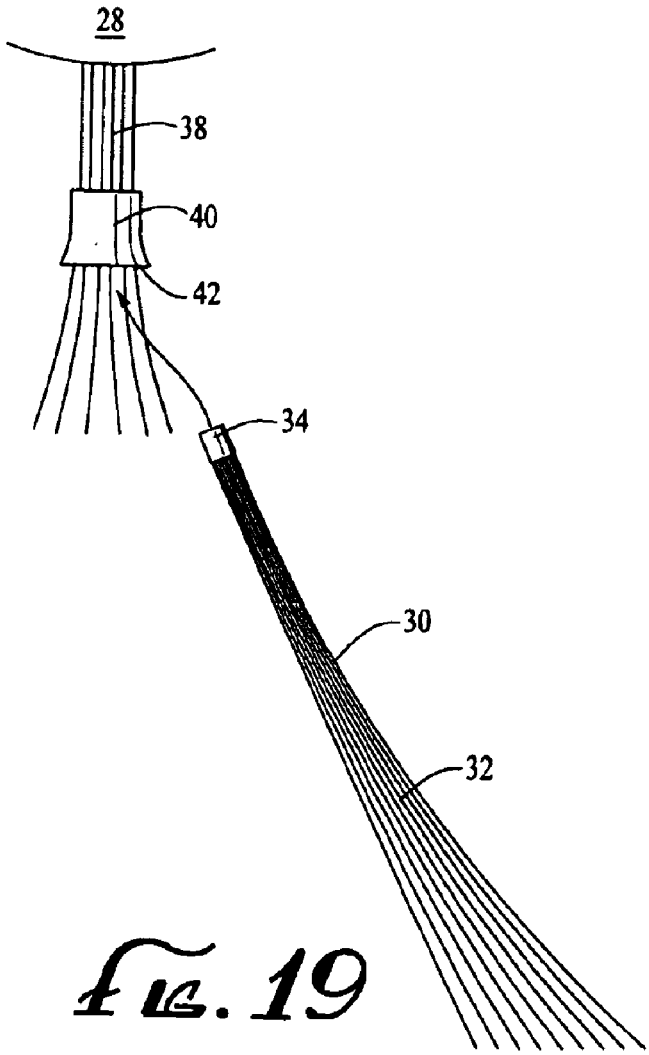
FIG. 19 shows the scalp hair in the collar prior to insertion of the hair extension.
Figure 20:
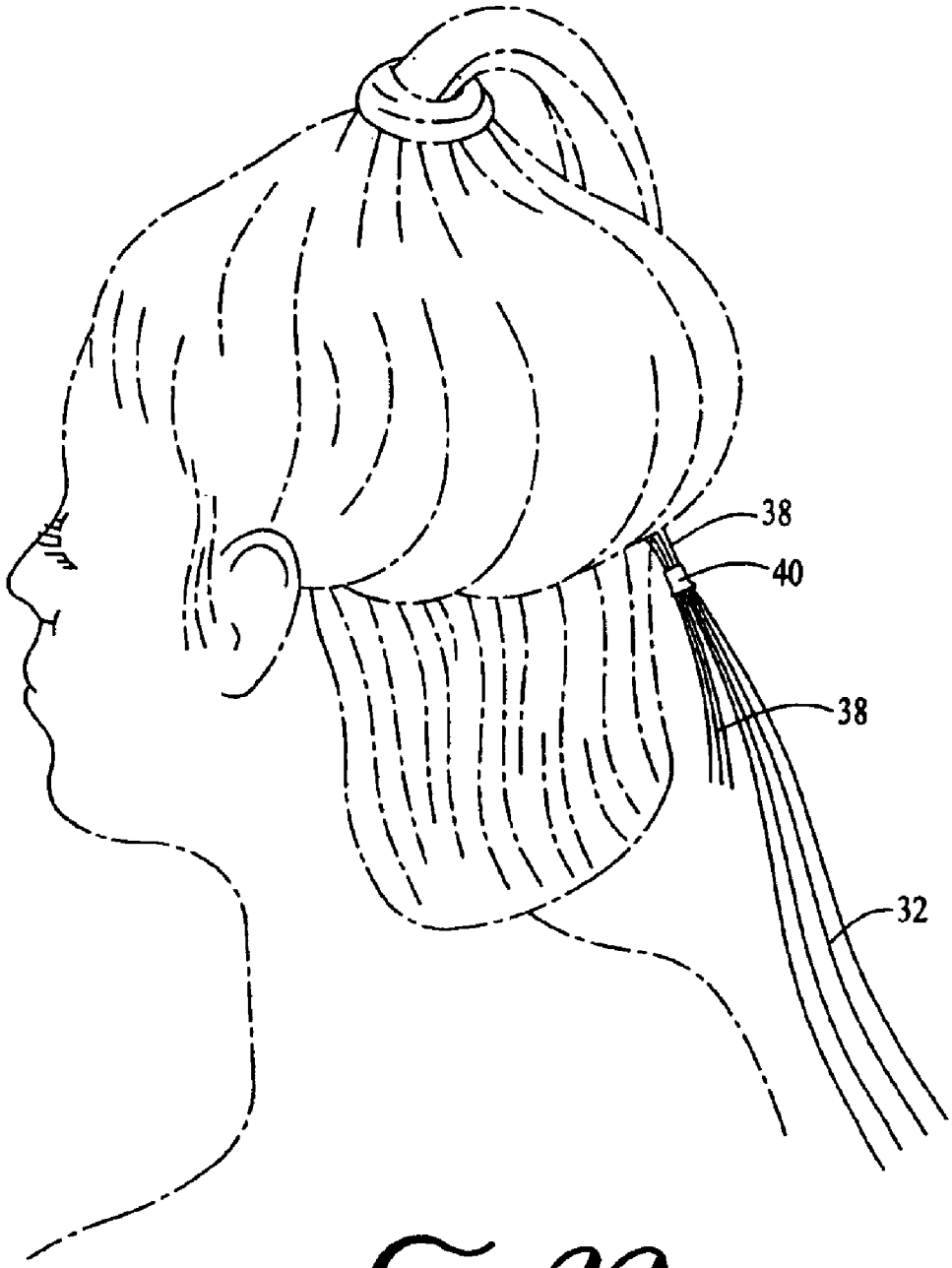
FIG. 20 shows a hair extension attached to the scalp hair of an individual utilizing the hair extension system and method of the invention.

A representative hair extension 30, shown in FIG. 10, comprises multiple strands 32 of natural hair, which can be human or animal hair, or synthetic fibers of a predetermined length held in a discrete bundle by a binding material 34 on and within the extension at an attachment end 36. Typical binding material is a pliable polymer such as polyethylene, or other thermoplastic polymers which are non-liquid at room temperature but molten at elevated temperatures at least above about 125° F. Alternatively, solvent based solvent systems can be used. Natural, modified natural or synthetic water soluble or swellable polymers, such as polysaccharides, alginates, gums, proteins, cellulose ethers, starch derivatives, polyacrylamide, polyvinyl alcohols, polyvinylpyrrolidone, polyacrylic acid, or polyphosphoric acid are preferred. However, this list is not intended to be all-inclusive and one skilled-in-the-art, based on the teachings herein will recognize that the beneficial results of the invention described herein can be obtained, and the method described can utilize hair extensions with many different binding materials. The color of the strands 32 in the extension 30 are typically selected to match or complement the color of the natural hair 38 growing from the scalp 28 of the individual receiving the hair extension. FIG. 20 shows an example of a single hair extension 30 after attachment to the head of an individual using the methods and devices incorporating features of the invention. A typical hair extension for use in the flared tube of the invention range has an insertion end diameter $D_E$ ranging from about 0.030 to about 0.070 inches, with the binding material covering about 0.2 to about 0.5 inches of the end of the extension, and will comprise from about 50 to about 250 strands of hair or fiber, the size of the bundle being chosen based on the dimensions of the flared tube selected. However smaller or larger bundles can be used within the invention disclosed Multiple flared tubes 40, shown in FIGS. 1 and 2, and in FIGS. 3–9, 18 and 19 in various embodiments and stages of the extension attachment procedure, are used to secure multiple hair extensions 30 to scalp hair 38. The preferred flared tubes 40 are thin walled cylindrical tubes that have at least one flared end 42. The flared end aids in threading the tube and inserting the attachment end 36 of the hair extension. The flare also functions to hold the tube slightly open, as shown in FIG. 4, so that the sharpened edge of a removal tool can be inserted as part of a removal process. These tubes 40 are preferable formed of malleable copper, aluminum or other readily bendable but not brittle metals or alloys, and are colored to match or complement the color of the hair extension 30 and/or the scalp hair 38 of the individual. They may also have friction reducing coatings on the inner surface thereof to make it easier to insert the attachment end 38 of the extension 30 or coatings with adhesive or water swellable properties to aid in holding the scalp hair 38 or extension 30 within the hollow central portion (the lumen) 44 of the flared tube. The dimensions of four typical flared tubes, which are provided as examples and are not intended to limit the scope of the invention regarding suitable dimensions, are listed in Table 1. One skilled in the art will recognize that, based on the teachings herein many different combinations of dimensions can be selected to meet the various sized hair extensions 30, or appearance desired to be generated. Also included in Table 1 are typical hair extension attachment end 36 diameters $D_E$ suitable for the various tube inner diameters. However, larger or smaller bundles may be used with the different tubes in conjunction with more or less scalp hair.

TABLE 1

TYPICAL FLARED TUBE DIMENSIONS (inches, ±0.002)

| | I | II | III | IV |
|---|---|---|---|---|
| Length, L | 0.195 | 0.187 | 0.102 | 0.065 |
| Outer Diameter $D_{O1}$ | 0.092 | 0.088 | 0.088 | 0.058 |
| Flare Diameter $D_{O2}$ | 0.140 | 0.122 | 0.130 | 0.089 |
| Inner Diameter $D_1$ | 0.067 | 0.072 | 0.068 | 0.046 |
| Wall Thickness | 0.0125 | 0.008 | 0.010 | 0.006 |
| Plug Diameter $D_E$ | 0.058–0.065 | 0.056–0.064 | 0.047–0.056 | 0.035–0.042 |

Figure 16:
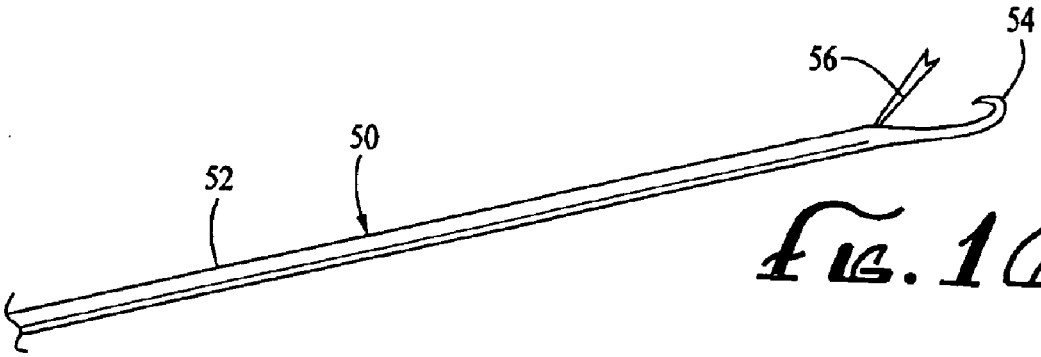
FIG. 16 is a side view of the hook end of an embodiment of a threading tool in its open configuration for feeding the scalp hair through the flared tube.
Figure 17:
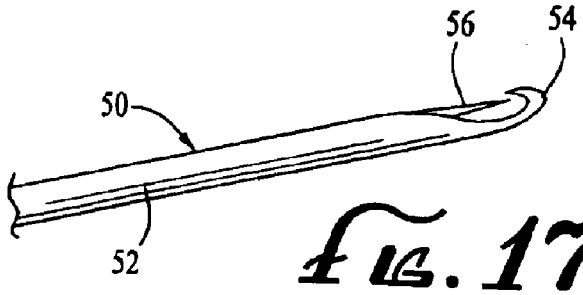
FIG. 17 is side view of the threading tool of FIG. 16 in its closed configuration.
Figure 18:
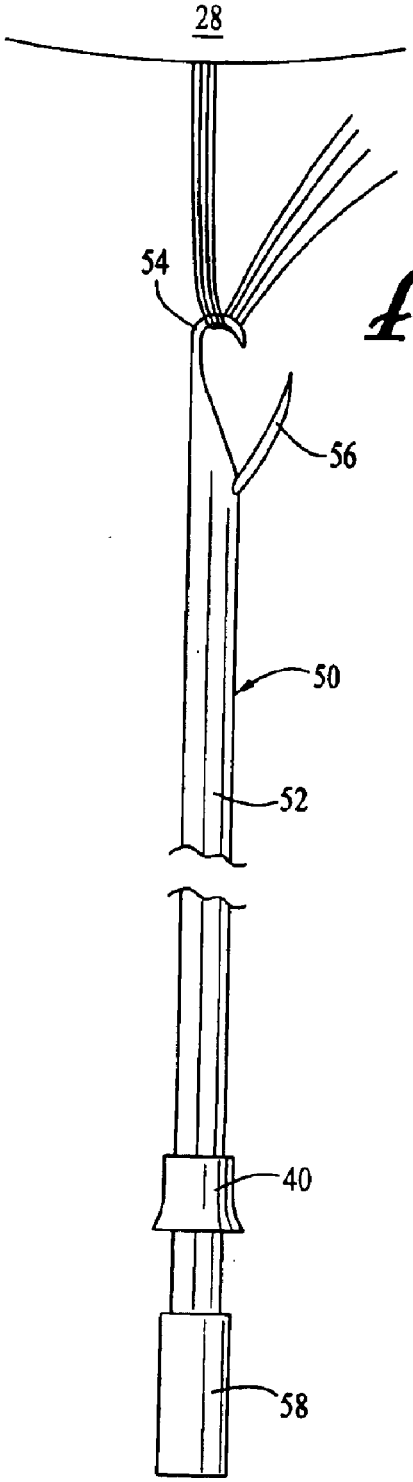
FIG. 18 is a side view of the threading tool holding scalp hair prior to placement of the flared tube.

FIGS. 16–18 show an embodiment of a threading tool 50 which may be used to thread scalp hair 38 through the lumen 44 of the flared tube 40. It comprises an elongated shaft 52, the diameter of which is selected to readily receive the different diameter flared tubes without being too tight or too loose for easy manipulation, with a first end having a hooked portion 54 for grabbing strands of hair. It may also include a keeper 56 that aids in holding the strands of hair in the hooked portion 54 as the strands of hair are pulled through the flared tube 40. The keeper 56, in the embodiment shown, is hinged so it is free to swing from an open position, as shown in FIG. 16, to a closed position as shown in FIG. 17. A larger diameter handle 58 is located on the other end of the shaft for grasping the threading tool 50 and to prevent the flared tube 40 placed on the shaft 52 of the threading tool 50 from falling off the second end.

Figure 11:
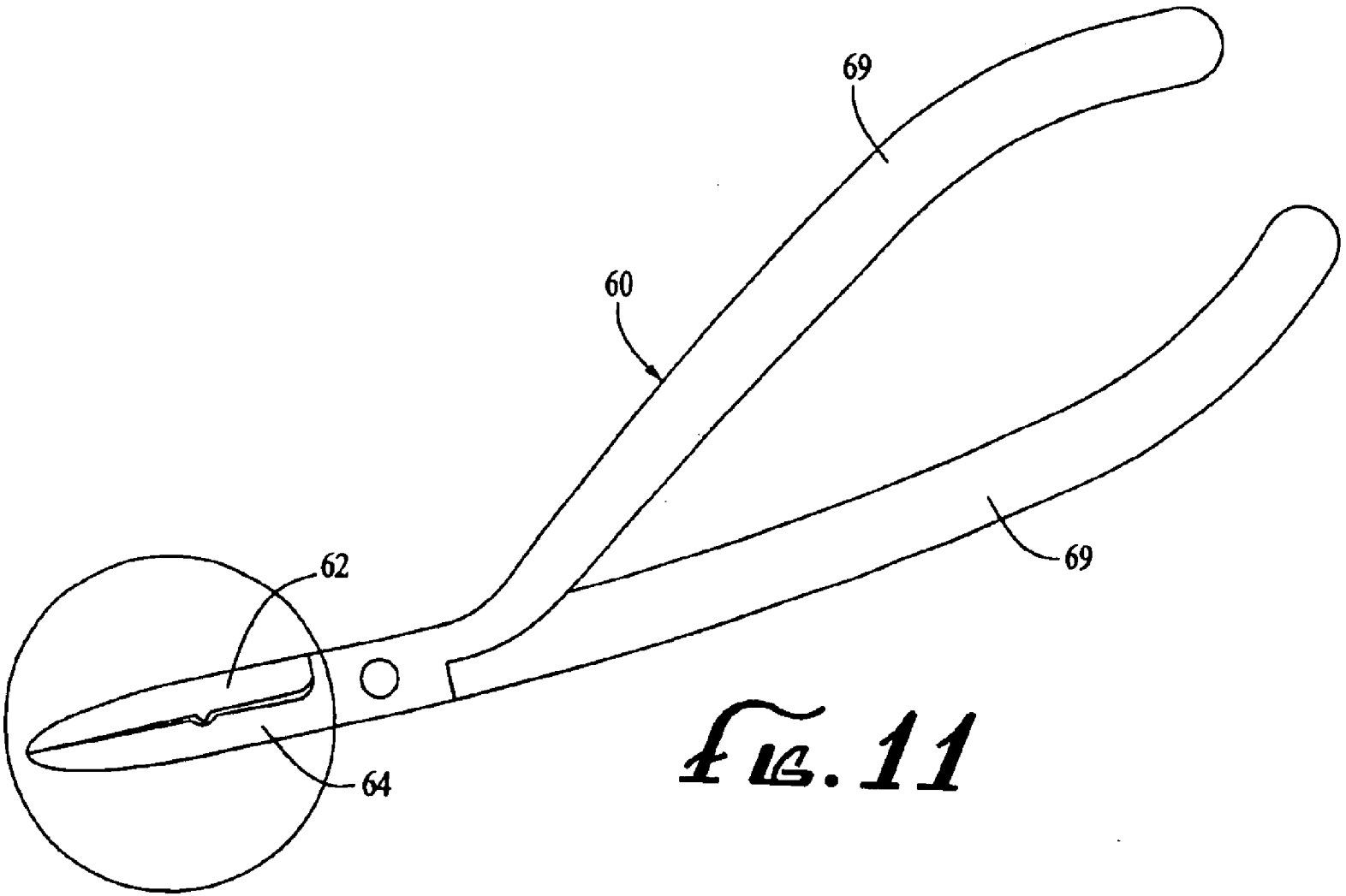
FIG. 11 is a perspective view of a crimping tool incorporating features of the invention.
Figure 12:
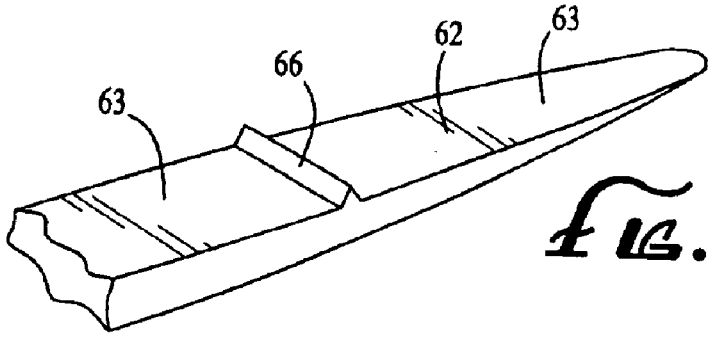
FIG. 12 is an enlarged view of a first jaw of the crimping tool of FIG. 7.
Figure 13:
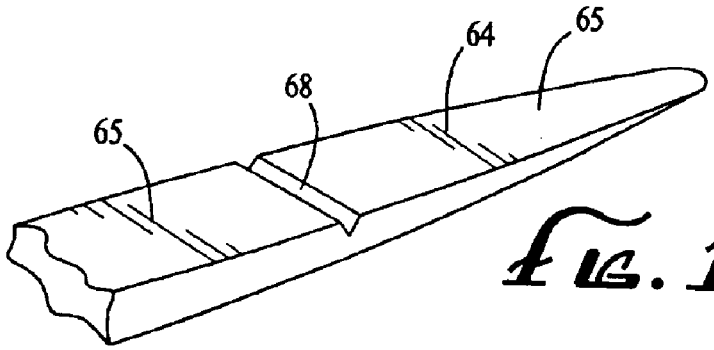
FIG. 13 is an enlarged view of a second jaw of the crimping tool of FIG. 7.

Once the scalp hair 38 and the attachment end 36 of the hair extension 30 are placed in the flared tube 40 the tube is crushed to retain the hair 38 and extension 30 within the flared tube 40. This is accomplished using a flattening or crimping tool 60. Various different devices, of which the embodiment shown in FIGS. 11–13 is an example, can be used. The crimping tool 60 is a plier-like device having an upper jaw 62 and a lower jaw 64 for grasping and crushing the central portion of the flared tube 40 by applying gripping pressure to the handles 69. In a preferred embodiment, as shown in the circled portion of FIG. 11 and enlarged in FIGS. 12 and 13 the upper jaw 62 has a ridge 66 extending across the jaw 62 surface and a the lower jaw 64 has a matching groove 68 extending across the lower jaw 64 surface, sized to receive the ridge 66 on the first jaw 62.

Figure 14:
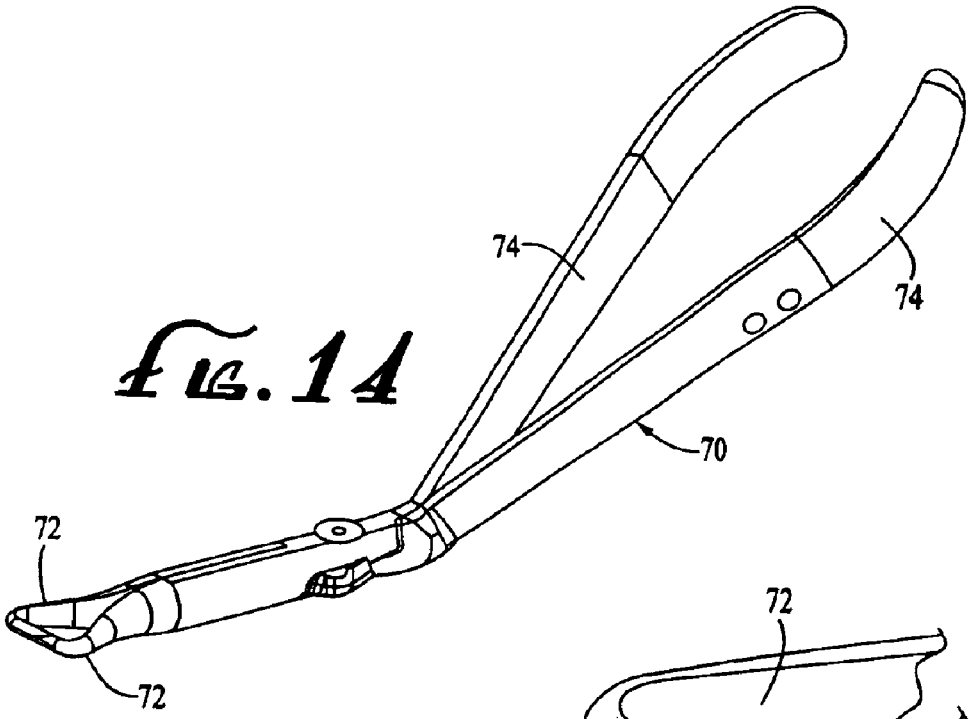
FIG. 14 is a perspective view of an embodiment of opening tool incorporating features of the invention for use to release the hair extension from a crimped tube
Figure 15:
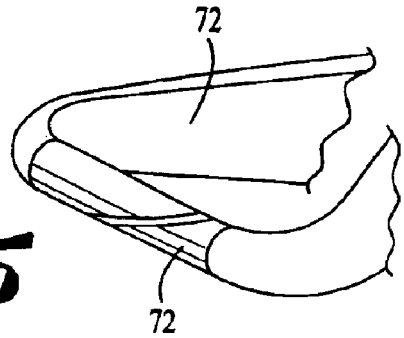
FIG. 15 is an enlarged view of the insert portion of the opening tool of FIG. 14.
Figure 21:
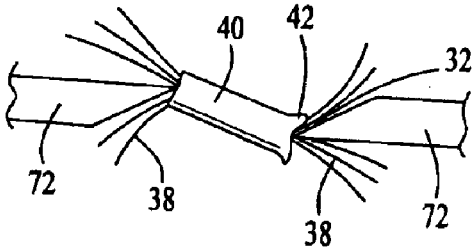
FIG. 21 shows a first embodiment of the releasing tool pointed end opening a crimped tube.
Figure 22:
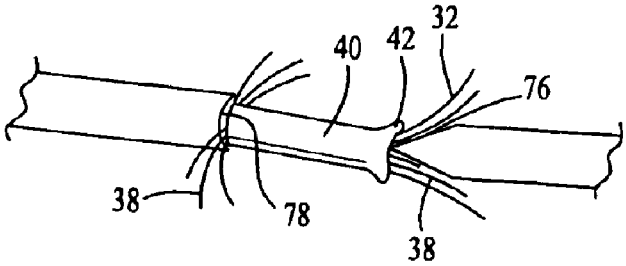
FIG. 22 shows a second embodiment of the releasing tool pointed end opening a crimped tube.

The attachment of the hair extension is not intended to be permanent. Therefore, an easy and efficient method is required to un-attach the hair extension that does not require cutting the hair or hair extension is provided. Shown in FIGS. 15 and 16 is a plier-like releasing tool 70 which has, in place of the jaws, first and second pointed extensions 72 which can be inserted into or against the opposite ends of the now crushed central portion 44 of the tube 40. As indicated above, the presence of the flared end provides a space between the inner walls of the tube at its flared ends after crushing to receive the pointed extensions 72. By applying gripping pressure to the handles 74 of the releasing tool 70, the crushed tube can be expanded. In the embodiment shown in FIGS. 14 and 15 the pointed extensions 72 comprise rods cut on a diagonal to create a sharp end for insertion in the ends of the crushed tube as shown in FIG. 21. Alternatively, one or both of the extensions 72 can have a pointed end 76 more centrally located. Still further only one of the extensions 72 may have a pointed end 76 while the second extension 72 may have a flat surface, or an indented surface 78 complementary to the pointed end 76 on the other extension 72 to receive one end of the crushed tube while the pointed end is inserted in the flared end 42 of the crushed tube 40.

To attach hair extensions to scalp hair it is preferred that the individual's hair be clean, oil free and dry. The hair is preferably combed and a part line established along which multiple sets of scalp hair can be separated into bundles of the desired size. Each bundle of scalp hair will receive a hair extension. A typical bundle of scalp hair will have from about ¼ to about ½ of the number of strands of hair as in the extension intended to be attached to it, depending on the thickness of the individuals hair, the thickness of the extension to be applied and the size of the flared tube to be used. The diameter of the insertion portion 42 of the hair extension and the size of the bundle of scalp hair is chosen so that the combination thereof substantially fills the inner diameter $D_1$ of the flared tube. A preferred procedure to apply a hair extension 30 to scalp hair 38 using an attachment system incorporating features of the invention comprises the following steps:

1. One or more flared tubes of the desired size and color are threaded on to the threading tool 40 with the flared end 42 towards the handle 58.

2. A flattened bundle of scalp hair 38, preferably about the width of the internal diameter of the tube, is captured in the hook portion 54 of the threading tool 40 (FIG. 18).

3. A flared tube is then slid up the threading tool 40 toward the scalp 28, preferably to within ¼ inch of the scalp, and the scalp hair 38 bundle is released from the threading tool 40 leaving the scalp hair 38 extending from the flared end 42 of the tube 40 (FIG. 19).

4. While grasping the flared tube 40 and scalp hair extending beyond the flare 42, the attachment end 36 of the hair extension 30 is inserted through the flared end 42 and into the tube 40 (FIG. 19).

5. The flared tube 40 is then placed between the flat portions 63, 65 of the upper and lower jaws 62, 64 of the crushing or crimping tool 60, and pressure is applied to the handles 69 to compress the tube, creating a flattened potion across or along some or all of the tube, as shown in FIG. 3, 7, 8 or 9, trapping the scalp hair 38 and insertion portion 36 of the hair extension within the crushed or crimped tube. Alternatively, the tube can be placed in the groove 68 and crimped by the ridge 66 The tube can then be further flattened by compressing it between flat, adjacent, parallel portions 63, 65 of the upper and lower jaws 62, 64. In either instance, a flattened tube is produced with a width approximating ½ of the original outer diameter of the center portion of the tube.

FIG. 20 shows the result of such a procedure for application of a single extension. The process is then repeated multiple times until the desired number of hair extensions have been added. The procedure can also be repeated across multiple part-lines on the scalp, or randomly, to create a layered effect and a fuller appearing head of hair. The attached hair extensions may be of different diameters or different colors to provide highlighting and shading to the finished head of hair.

To reverse the addition of the hair extension one of the sharpened extensions 72 of the releasing tool 70 is inserted into the slightly open but crushed flared end 42 of the tube, the second extension 72 is then inserted in or placed against the other end of the tube and compressive forces are applied to handles 74 of the releasing tool 70, causing the crushed tube to expand. The tube can then be slid down the scalp hair bundle away from the scalp, to remove the flared tube and hair extension from the bundle of scalp hair. This process may be aided by applying some heat to the tube and rotating it during the process.

Figure 23:
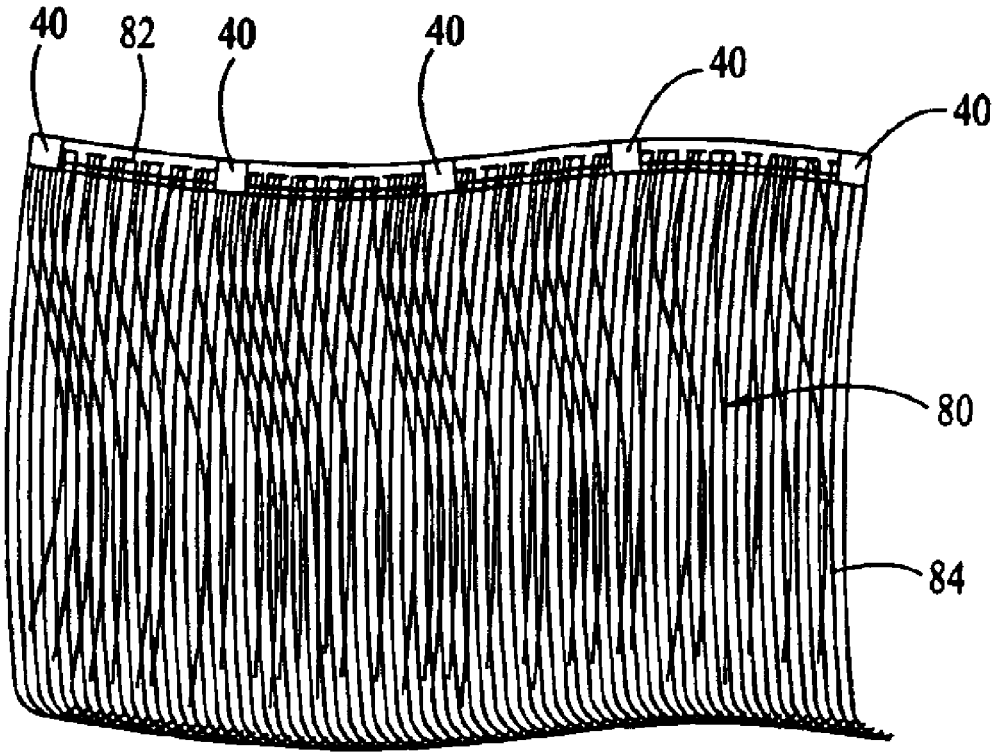
FIG. 23 shows a wide hair extension incorporating, and attachable, using features of the invention.

One skilled in the art, based on the teachings herein, will recognize that the attachment system and method for using same described herein is not limited to the attachment of the hair extension 30 described above. For example, FIG. 23 shows a wide hair extension 80 which may be comprise multiple hair extensions 30 attached to a mounting band 82. Alternatively, the wide hair extension 80 can comprise numerous strands of hair in a flat array attached to the mounted band 82. The attachment band 82 may be a separate piece of material or may be formed by weaving or braiding the upper end of hair strands 84 into a structure suitable to hold the wide hair extension in a configuration suitable for mounting to an individual's head. Multiple flared tubes 40 are attached to the band by gluing, sewing, etc. To apply the wide hair extension 80, scalp hair 38 is threaded through each of the flared tubes 40 and the tubes are crimped or crushed as described above. Separate hair extensions may also be inserted into the flared tubes 40, as described above, prior to crushing the tube. The wide hair extension 80 typically has a width of from about ½ inch to 6 inches but wider or narrower extensions 80 may be used.

Figure 24:
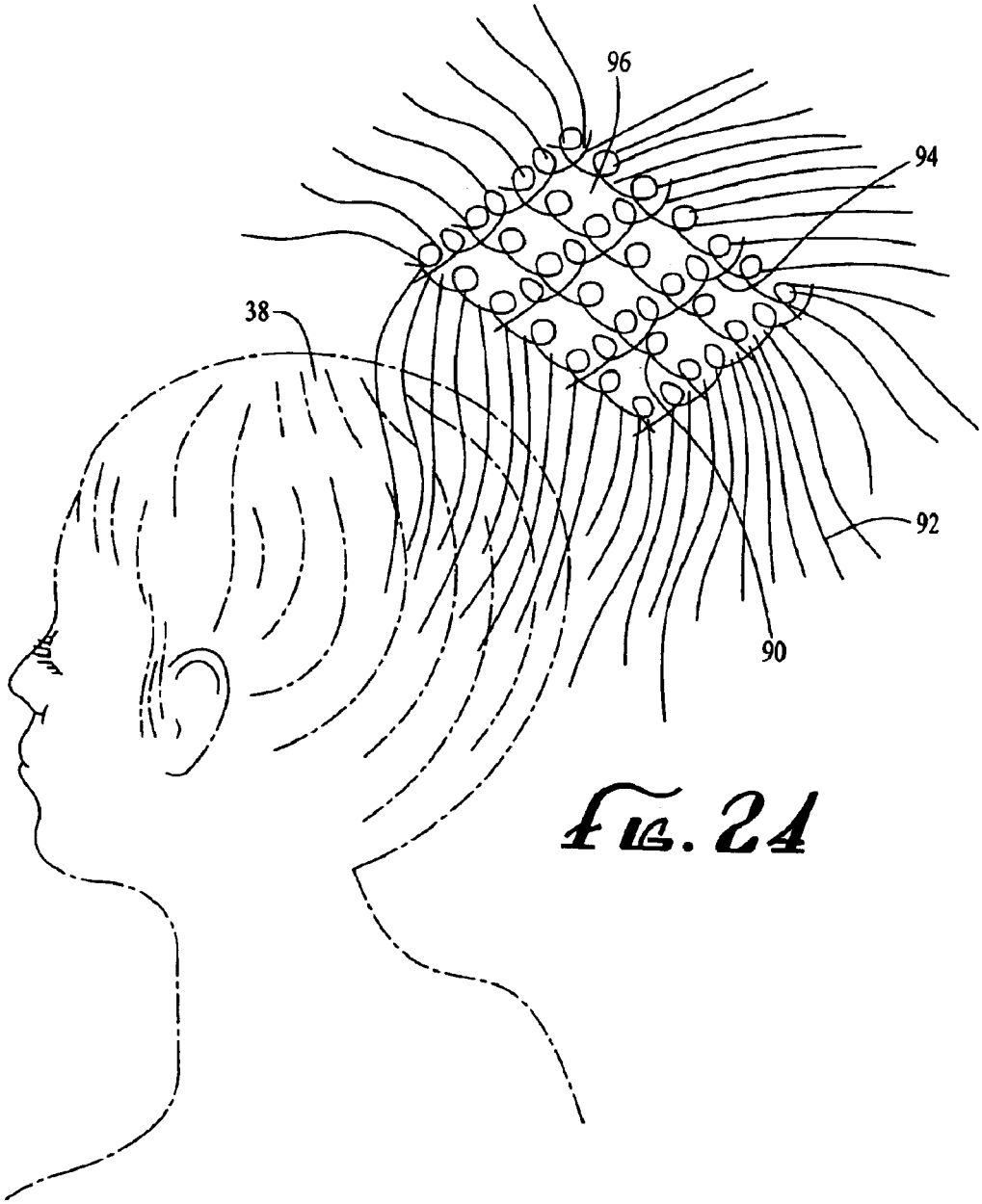
FIG. 24 shows a hair piece attachable using features of the invention.

A still further embodiment utilizes the extension attachment system for applying wigs or hairpieces 90. A preferred hairpiece would include apertures 96 for pulling strands of scalp hair 38 there through. In FIG. 24 these apertures 96 are spaces in the central portion of the hair piece 90 which consists of an open mesh, or woven structure formed from the strands or hair or fiber 92 used to construct the hair piece 90. To mount the hair piece on an individuals head, bunches of scalp hair 38 are pulled through the apertures and hair extensions 30 are added to the scalp hair 38 as described above. In addition, small bundles of hair or fiber 92 from hair piece 90 can be gathered with scalp hair 38, threaded together through the flared tube, in the manner as described above, and then hair extensions 30 can be added to the combined scalp hair 38 and hairpiece fiber 92.

It is evident from the foregoing that there are many additional embodiments of the present invention which, while not expressly described herein, are within the scope of this invention and may suggest themselves to one of ordinary skill in the art. For example, the invention. It is therefore intended that the invention be limited solely by the appended claims.

What is claimed is:

1. A process for adding hair or artificial fiber supplements to scalp hair comprising:

a. threading one or more flared tubes of a predetermined size and color onto a threading tool with a flared end on the one or more flared tubes towards an enlarged handle on the threading tool, b. capturing a flattened bundle of scalp hair in a hook portion of the threading tool, c. sliding the flared tube along the threading tool and over the hook portion toward the scalp d. releasing the scalp hair bundle from the threading tool leaving the scalp hair extending from the flared end of the tube, e. inserting an attachment end of a hair extension through the flared end of the tube and into a lumen within the tube, f. crimping the tube by compressing it between a ridge and a groove on opposed flat parallel faces of upper and lower jaws of a flattening tool, g. placing the crimped flared tube between opposed flat parallel faces of upper and lower jaws of a flattening tool and, h. using the flattening tool, applying pressure to the tube, compressing the tube, creating a flattened portion across and along the tube trapping the scalp hair and inserted portion of the hair extension within the crimped tube.

2. The process of claim 1 wherein the tube is crimped along the full extent of its length.

3. The process of claim 1 wherein the hair or artificial fiber supplements added to scalp hair comprise a bundle of multiple strands of hair with one end there of bound into an insertable plug, multiple hair extensions attached to a scalp mountable band, or a hair piece.

4. The process of claim 3 wherein the insertable plug on the bundle of multiple strands of hair is formed by applying a water soluble or water swellable polymer to the end of multiple strands of hair or fiber.

5. The process of claim 1 wherein the cross sectional volume of the combination of hair or artificial fiber and scalp hair substantially fills the lumen extending longitudinally through the flared tube.

* * * * *